US011760616B2

(12) United States Patent
Rusconi et al.

(10) Patent No.: US 11,760,616 B2
(45) Date of Patent: Sep. 19, 2023

(54) CAPPING MACHINE FOR APPLYING CAPSULES ON RESPECTIVE CONTAINERS IN ASEPTIC OR ULTRACLEAN CONDITIONS

(71) Applicant: SIDEL PARTICIPATIONS, Octeville-sur-Mer (FR)

(72) Inventors: Luigi Rusconi, Parma (IT); Michele Soncini, Parma (IT); Alessandro Fusaro, Parma (IT)

(73) Assignee: SIDEL PARTICIPATIONS, Octeville-sur-mer (FR)

( * ) Notice: Subject to any disclaimer, the term of this patent is extended or adjusted under 35 U.S.C. 154(b) by 75 days.

(21) Appl. No.: 17/618,420

(22) PCT Filed: Apr. 6, 2020

(86) PCT No.: PCT/EP2020/059713

§ 371 (c)(1),
(2) Date: Dec. 10, 2021

(87) PCT Pub. No.: WO2020/249286

PCT Pub. Date: Dec. 17, 2020

(65) Prior Publication Data

US 2022/0306442 A1 Sep. 29, 2022

(30) Foreign Application Priority Data

Jun. 10, 2019 (EP) ..... 19179285

(51) Int. Cl.
*B67B 3/20* (2006.01)

(52) U.S. Cl.
CPC ..... *B67B 3/2033* (2013.01); *B67B 3/2086* (2013.01); *B67B 2201/08* (2013.01)

(58) Field of Classification Search
CPC ... B67B 3/2013; B67B 3/2033; B67B 3/2073; B67B 3/2086; B67B 2201/08
(Continued)

(56) References Cited

U.S. PATENT DOCUMENTS 9,187,304 B2 * 11/2015 Kampmann et al. ..... B67B 3/2013
9,340,310 B2 * 5/2016 Knieling et al. ..... B67B 3/2033
(Continued)

FOREIGN PATENT DOCUMENTS

CN 101152951 A 4/2008
CN 109863111 A 6/2019
(Continued)

OTHER PUBLICATIONS

Application PCT/EP2020/059713,filed Apr. 6, 2020, International search report dated Jun. 23, 2020.

*Primary Examiner* — Stephen F. Gerrity

(57) ABSTRACT

The invention relates to a capping machine comprising a protected area from impurities, an unprotected area divided from the protected area by a parting wall, and an operating unit. The operating unit includes a container support element arranged in the protected area, an operating head arranged in the protected area and configured to apply one capsule on the relative container, a motor assembly arranged in the unprotected area and configured to drive motion of the operating head, a torque control head between the motor assembly and the operating head, and an annular bellows element coaxial with the vertical axis and within the protected area and one opposite axial end crossed in a sealed manner by an output shaft of the torque control head. The torque control head is arranged above the parting wall in the unprotected area and the output shaft crosses said opening and the entire bellows element.

11 Claims, 3 Drawing Sheets

(58) Field of Classification Search
USPC ..... 53/302, 317, 331.5
See application file for complete search history.

(56) References Cited

U.S. PATENT DOCUMENTS

| | | | | |
|---|---|---|---|---|
| 2005/0229540 | A1* | 10/2005 | Monti | B67B 3/2033 53/317 |
| 2008/0078144 | A1* | 4/2008 | Cirio | B67B 3/2033 53/359 |
| 2010/0126116 | A1* | 5/2010 | Buchhauser et al. | B67B 3/2033 53/287 |
| 2011/0072762 | A1* | 3/2011 | Jakob | B67B 3/2033 53/285 |
| 2011/0247301 | A1* | 10/2011 | Buchhauser et al. | B67B 3/2033 53/285 |
| 2012/0210673 | A1* | 8/2012 | Schoenfelder | B67B 3/2033 53/111 R |
| 2015/0375980 | A1* | 12/2015 | Naaber et al. | B67B 3/2033 53/317 |
| 2020/0391988 | A1* | 12/2020 | Siemens | B67B 3/2033 |

FOREIGN PATENT DOCUMENTS

| | | | | |
|---|---|---|---|---|
| DE | 10 2008 056242 | A1 | 5/2010 | |
| DE | 20 2010 013681 | U1 | 11/2010 | |
| DE | 10 2013 101716 | A1 | 8/2014 | |
| EP | 0639529 | B1 * | 6/1995 | B67B 3/208 |

* cited by examiner

CAPPING MACHINE FOR APPLYING CAPSULES ON RESPECTIVE CONTAINERS IN ASEPTIC OR ULTRACLEAN CONDITIONS

TECHNICAL FIELD

The present invention relates to a capping machine for applying threaded capsules on respective containers in aseptic or ultraclean conditions.

BACKGROUND ART

As it is known, in the capping of containers under aseptic or ultraclean conditions, to avoid contamination, the area in which the capping operation is carried out on the containers must be suitably isolated from the external environment and protected from impurities or even kept sterile.

According to a first embodiment, the capping machine as well as the other machines used in a typical bottling plant are totally inserted inside voluminous chambers kept in overpressure with respect to the external environment. In practice, the air has a unidirectional flow towards the outside in correspondence of the openings necessary for the entry/exit of the containers in/from the rooms in which the machines and system components are inserted. In this way, the possible entry of microorganisms into the treatment area of the containers is prevented.

However, since the sizes of the machines, generally rotary, are considerable, the isolated chambers are so large that they are difficult to manage and maintain in sterile or ultraclean conditions.

According to another known solution, to reduce the size of the chambers, only the process areas of the machines are isolated, leaving the remaining part of the latter in the unprotected atmosphere area.

In rotary-type capping machines, the process area to be isolated is usually defined between a rotating and a fixed part and a barrier is required between the rotating part, in which operating units are mounted, and the fixed walls, such as for example the protective casing towards the outside of the machine or towards the transmission members.

For this purpose, gaskets of elastomeric material, generally applied to the rotating part, are used which slide on the normally metallic fixed part.

Considering that the main conditions of reliability of the solution (smooth, hard sliding surface, with low coefficient of friction and parallel to the gasket, low sliding speeds) contrast with the considerable sizes of the machines that prevent, due to machining tolerances and production speed required, the attainment of these conditions, it can be understood that the main drawbacks of this solution are due to the rapid wear of the gaskets with consequent loss of seal.

Another known solution involves the use of labyrinth seals, which overcome the problems of wear of the gaskets because they do not involve any physical contact between the parts in relative movement.

However, the goodness of the seal depends on the distance between the moving parts: as this distance decreases, the quality of the seal increases, but achieving reduced distances (i.e. tenths of a millimeter) is particularly complex and expensive in machines so large because the tolerances of mechanical processes are such as to make it difficult to reach such small distances.

With this solution then a further possible way of exchanging air with the external environment is given by the labyrinth seals and therefore, in order to obtain an adequate overpressure, a greater flow of sterile or ultraclean air is required, with higher costs and with the risk of lack of isolation.

A further solution has therefore been identified, illustrated in the patent EP-B-1601606 in the name of the same applicant, consisting in providing a fixed annular channel partly filled with a sterile liquid in which a coaxial annular element associated to the rotating part is sliding in a rotary manner.

This latter solution is not clearly subject to wear and does not require expensive mechanical processing to ensure reduced coupling tolerances between the parts that make the seal.

However, this solution is exclusively suitable for ensuring the seal between a fixed part and a part equipped with pure rotary movement. In the case in which the rotating part includes members provided with translational motion and displaceable in use between the unprotected atmosphere area and the protected or sterile atmosphere area of the machine, like in the capping machines, it is necessary to resort to additional sealing elements, generally bellows elements, which permit to obtain satisfactory results in terms of sealing performed and associated costs.

A typical solution of a capping machine of this type includes a driving shaft rotating about a vertical axis, and a plurality of operating units, arranged equally spaced angularly about the vertical axis, angularly connected to the driving shaft and configured to cap respective containers with threaded capsules.

Each operating unit comprises:

- a container support element configured to receive a relative container arranged vertically;
- an operating head coaxially arranged above the container and adapted to apply a capsule on the container hold by the container support element;

a driving mandrel coaxially connected to the operating head on the opposite side to the one designed to cooperate in use with the relative container;

- a motor assembly for imparting a roto-translational motion to the driving mandrel along and around its axis; and
- a torque control head interposed between the driving mandrel and the operating head and configured to limit the maximum torque transmitted from the driving mandrel to the operating head.

The various motor assemblies (each of which typically includes a motor and, where necessary, transmission gears, bearings, cam elements, etc.) of the operating units are housed in a drum casing surmounting the driving shaft and arranged in the unprotected atmosphere area.

The container support elements and the operating heads are instead housed in the protected or sterile atmosphere area of the capping machine, below the drum casing. The same applies to the torque control head that is typically maintained as close as possible to the operating head to better drive the movement of the latter.

Each driving mandrel extends in part within the drum casing in the unprotected atmosphere area and in part within the protected or sterile atmosphere area through a respective bellows element; each driving mandrel is subjected to a translational movement along its axis to and away from the relative container as well as to a rotational movement around its axis.

An example of torque control head is disclosed in EP-B-2407415 and includes:

- a top element directly and coaxially connected to the relative driving mandrel;

an intermediate element angularly coupled with the top element and axially displaceable with respect to the top element by means of elastic compression springs;

a tubular bushing angularly coupled to the intermediate element and axially protruding therefrom towards the relative container support element;

an operating shaft coaxially extending through the tubular bushing, axially protruding from the tubular bushing towards the relative container support element and carrying at its free end the operating head; and a magnetic clutch, typically made up of two magnetic clutch disks, radially interposed between the tubular bushing and the operating shaft and configured to define the maximum torque transmitted from the tubular bushing to the operating shaft and therefore to the operating head.

In particular, the operating shaft of each operating unit is supported within the tubular bushing by a pair of bearings; in this way, the operating shaft is mounted rotationally free within the tubular bushing. The torque transmission from the tubular bushing to the operating shaft is achieved by the magnetic clutch up to a given threshold torque value. In particular, at the end of screwing a capsule on the relative container, the torque required to continue the screwing action exceeds the aforementioned threshold torque value and the magnetic clutch disks rotate relative to one another so as to stop any further torque transmission that may prejudice the capsule correct application.

Since the torque control head includes "dirty elements", such as bearings and magnetic clutch disks, that may contaminate the protected or sterile atmosphere area, it is necessary to prevent any fluid passage between the inside of the torque control head and the protected or sterile atmosphere area.

In addition, the protected or sterile atmosphere area requires frequent washings of the parts arranged therein with chemical substances that may damage some mechanical elements present in the torque control head, like bearings and magnetic clutch disks.

In order to isolate the protected or sterile atmosphere area from the dirty elements of the torque control head, a huge number of gaskets have to be provided within the torque control head with consequent high costs and complication of maintenance operations.

Moreover, the known solutions of capping machines still present a high number of points of possible contamination within the protected or sterile atmosphere area.

DISCLOSURE OF INVENTION

It is therefore an object of the present invention to provide a capping machine, which is designed to overcome the above-mentioned drawbacks in a straightforward and low-cost manner.

This object is achieved by a capping machine as described herein.

BRIEF DESCRIPTION OF THE DRAWINGS

A non-limiting embodiment of the present invention will be described hereafter by way of example with reference to the accompanying drawings, in which.

BEST MODE FOR CARRYING OUT THE INVENTION

Figure 1:
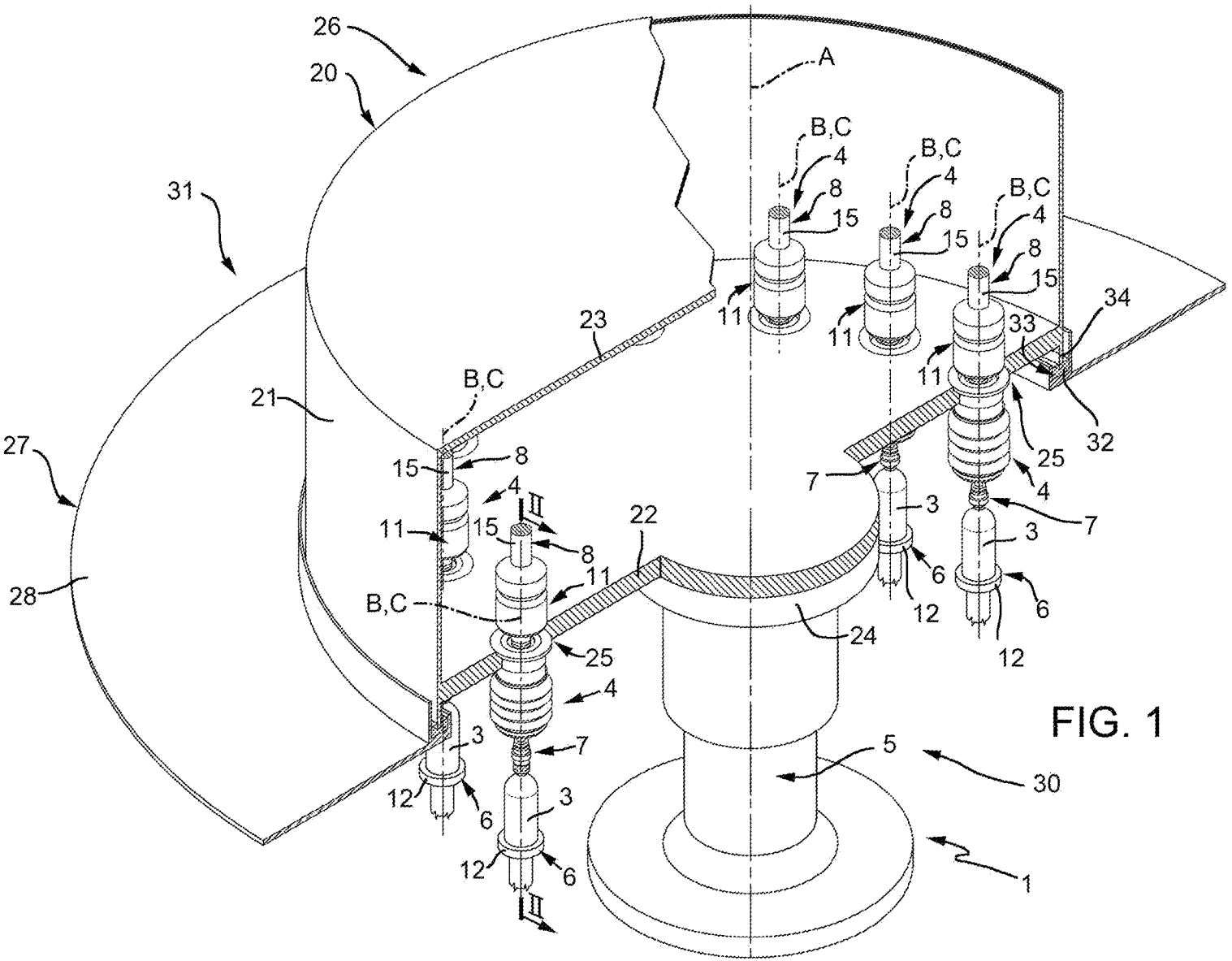
FIG. 1 schematically shows a partially-sectioned perspective view, with parts removed for clarity, of a capping machine in accordance with the teachings of the present invention.
Figure 2:
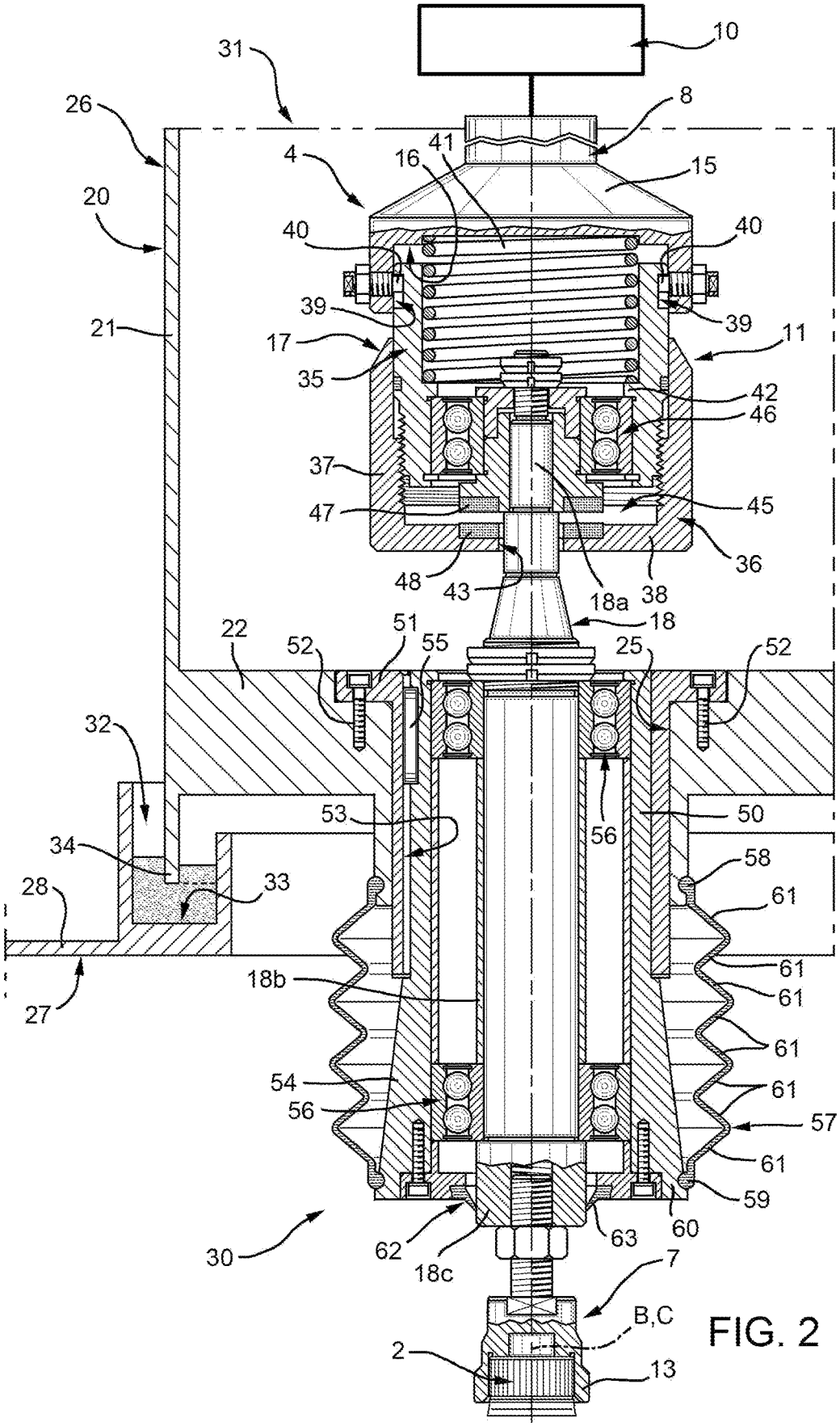
FIG. 2 is a larger-scale section along line II-II of FIG. 1, with parts removed for clarity.

With reference to FIGS. 1 and 2, number 1 indicates as a whole a capping machine configured to apply threaded or non-threaded capsules 2 (FIG. 2) on respective containers 3, in particular bottles, in aseptic or ultraclean conditions.

The machine 1 comprises a plurality of stations or operating units 4 configured to perform respective capping operations on the containers 3 and arranged equally spaced angularly about a vertical central axis A.

The operating units 4 are also rotatable about the central axis A and receive the containers 3 to be closed by an input star wheel (known per se and not shown); the closed containers 3 are then released to an output star wheel (also known per se and not shown) arranged in a position adjacent to the input star wheel.

The operating units 4 are angularly connected to a driving shaft 5 coaxial to central axis A.

In particular, each operating unit 4 (FIGS. 1 and 2) presents a vertical axis B parallel to the central axis A and comprises:

a container support element 6 configured to receive a relative container 3 arranged vertically, i.e. with its own axis C parallel to the axis A and coaxial with the respective axis B;

an operating head 7 coaxially arranged above the relative container 3 to apply one capsule 2 on the container 3 itself hold by the container support element 6;

a driving mandrel 8 (known per se and only partially shown in FIGS. 1 and 2) coaxial with the relative axis B and configured to drive motion of the operating head 7 along and around the axis B itself;

a motor assembly 10 (FIG. 2) for imparting a roto-translational motion to the driving mandrel 8 along and around the respective axis B; and a torque control head 11 interposed between the driving mandrel 8, or the motor assembly 10, and the operating head 7 and configured to limit the maximum torque transmitted from the driving mandrel 8, or the motor assembly 10, to the operating head 7.

In particular, in the example shown, the container support element 6 of each operating unit 4 includes a resting plate 12 extending orthogonally to the relative axis B and configured to receive, on its top surface, one respective container 3.

As a possible alternative not shown, each container support element 6 may include a gripping element supporting the relative container 3 at its top portion or neck in a suspended way.

Each container support element 6 is configured to limit axial and rotational movements of the relative container 3.

The operating head 7 of each operating unit 4 includes a gripping member 13 (FIG. 2) configured to coaxially grip threaded or non-threaded capsules 2 that are to be screwed or applied on the tops of containers 3.

Each driving mandrel 8 is only shown limited to a driving portion 15 directly connected to the respective torque control head 11 and selectively moved, in a way known per se and not shown, by the relative motor assembly 10 along and around its axis B.

Driving portion 15 of each driving mandrel 8 has, at its end connected to the relative torque control head 11, a head recess 16, whose function will be clarified hereafter.

With particular reference to FIG. 2, each torque control head 11 has an input element 17, directly connected to the driving portion 15 of the relative driving mandrel 8, and an output shaft 18 extending coaxially to the relative axis B and connected at its free end to the respective operating head 7.

Each output shaft 18 is rotatable about the relative axis B and can translate along this axis under the action of the respective motor assembly 10 and driving mandrel 8, so as to cause a corresponding rotation of the respective operating head 7 and a corresponding translation thereof to and away from the respective container 3 and, therefore, to and away from the respective container support element 6.

As can be seen in FIGS. 1 and 2, the motor assemblies 10, each of which comprises in addition to the actual motor also transmission gears, bearings, cam elements (all known per se and not shown), etc., and the driving mandrels 8 are housed in a drum casing 20 surmounting the driving shaft 5 and radially cantilevered with respect to the latter.

More specifically, the drum casing 20 is delimited by a cylindrical side wall 21 closed, at its lower end, by a discoidal bottom head wall 22 and, at its upper end, by a discoidal top head wall 23 facing the bottom head wall 22.

As shown in FIG. 1, bottom head wall 22 of drum casing 20 is secured to an annular flange 24 of the upper end of the driving shaft 5.

Advantageously, even the torque control heads 11 are housed in the drum casing 20, whilst the output shafts 18 extend, in a sealed manner, through respective openings of the bottom head wall 22 of the drum casing 20 itself so as to project downwards from the latter along with the respective operating heads 7.

In practice, the driving shaft 5, the drum casing 20 and the operating units 4 define a rotational part 26 of the machine 1 cooperating with a fixed part 27 of the machine 1 itself arranged in a radially outermost position.

In the case shown in FIG. 1, the fixed part 27 comprises an annular platform 28 extending around the drum casing 20 and approximately at the same height as, or slightly below, the bottom head wall 22 of the drum casing 20 itself.

As can be seen in FIGS. 1 and 2, the bottom head wall 22 of the casing 20 and the annular platform 28 delimit in the lower part a process environment, or more precisely a closed environment for the containers 3, which is isolated from the external environment and kept in sterile or ultraclean conditions (i.e. protected from impurities) and in slight overpressure.

This closed environment therefore defines a protected or sterile atmosphere area 30 of the machine 1, in which the containers 3 carried by the respective container support elements 6 pass.

The entrance of the containers 3 to be capped and the exit of the containers 3 in the capped form in/from the protected or sterile atmosphere area 30 is permitted through suitable openings (not shown) in the lateral bounding walls (known per se and not shown) of this area.

The environment located above the annular platform and the bottom head wall 22 of the drum casing 20 defines instead an unprotected or non-sterile atmosphere area 31 of the machine 1.

The protected or sterile atmosphere area 30 and the unprotected or non-sterile atmosphere are 31 are separated from each other by sealing means 32. In the present case, the sealing means 32 comprise a fixed annular channel 33, associated with the fixed part 27 and partially filled with a sterile liquid, and an annular element 34 associated with the rotating part 26, coaxial with the annular channel 33 and rotatable in use in the liquid of the annular channel 33 itself.

In particular, the annular channel 33 extends in overhang towards the axis A from the radially innermost edge of the annular platform 28.

The annular element 34 is instead defined by a downward annular extension of the side wall 21 of the drum casing 20, projecting in a cantilevered manner from the bottom head wall 22. The annular element 34 can be partially immersed in the liquid of the annular channel 33 and moves inside the annular channel 33 itself dragged by the rotation of the drum casing 20.

The sterile liquid, which is preferably a bacteriostatic liquid, that is capable of eliminating any bacteria, for example a solution of water and chlorine, acts as an insulator preventing the contact between the protected or sterile atmosphere area 30 and the surrounding external environment.

Due to the slight overpressure inside the protected or sterile atmosphere area 30, a difference in level (of a few mm of water and equal to the overpressure created) is formed between the liquid present in the annular channel 33 located in contact with the sterile or protected atmosphere area 30 and the one located outside the annular element 34 in contact with the external environment.

With particular reference to FIG. 2, the input element 17 of the torque control head 11 of each operating unit 4 comprises:

- a tubular element 35 coaxial with the respective axis B and having a top portion partially engaging, in a sliding manner, the head recess 16 of driving portion 15 of the respective driving mandrel 8; and
- a substantially cup-shaped bushing element 36 having a cylindrical side wall 37, externally and coaxially coupled to a bottom portion of the tubular element 35, and a head wall 38 connected to a bottom annular edge of side wall 37 and axially facing the head recess 16.

In particular, each tubular element 35 has a plurality of external longitudinal slots 39, which are parallel to axes A, B and are equally spaced angularly about the relative axis B. The slots 39 are coupled, in a sliding manner parallel to axes A, B, with respective pins 40 radially protruding towards the axis B itself from the side walls of the driving portion 16 of the relative driving mandrel 8 delimiting the relative head recess 16. This arrangement allows limited movements of the tubular element 35 of each torque control head 11 along the relative axis B with respect to the driving portion 15 of the relative driving mandrel 8. These axial movements are controlled by a cylindrical helical spring housed within the relative tubular element 35 and axially interposed between a head wall of the relative head recess 16 and an intermediate annular shoulder 42 radially protruding inwards from the lateral wall of the tubular element 35 itself. Thanks to the presence of the springs 41, it is possible to cushion the impact of the operating heads 7 onto the containers 3 to be capped.

Each bushing element 36 is angularly and axially coupled to the relative tubular element 35. Since the side wall 37 of the bushing element 36 is internally threaded and engages an outer thread provided on a bottom portion of the tubular element 35, it is possible to adjust in known manner the axial relative position between the bushing element 36 and the tubular element 35. The aim of this function will be explained later on.

The output shaft 18 of each torque control head 11 has a top portion **18*a* housed within both the relative tubular element 35 and the relative bushing element 36 and crosses the relative head wall 38 at a through central opening 43 thereof so as to protrude axially from the head wall 38 itself towards the relative operating head 7 and the bottom head wall 22 of drum casing 20**.

The top portion 18*a* of each output shaft 18 is coupled to the relative tubular element 35, and therefore to the relative driving mandrel 8, by a magnetic clutch 45.

In particular, the top portion 18*a* of each output shaft 18 is mounted within the relative tubular element 35 and the relative bushing element 36 in an angularly free manner about the relative axis B and is supported by the tubular element 35 itself by means of a bearing 46, in particular a ball bearing.

In the example shown, each magnetic clutch 45 includes a top magnet 47, shaped preferably like an annular disk and carried by the top portion 18*a* of the relative output shaft 18, and a bottom magnet 48, also shaped preferably like an annular disk, carried by the head wall 38 of the relative bushing element 36 and arranged at a given distance along the relative axis B from the top magnet 47.

The axial distance between each pair of top and bottom magnet 47, 48 defines the maximum torque transmitted by means of the magnetic clutch 45 from the relative tubular element 35 to the relative output shaft 18.

The value of the maximum torque transmitted from the input element 17 of each torque control head 11 to the relative output shaft 18 can be adjusted by changing the axial distance between the relative top and bottom magnets 47, 48; in particular, this adjustment can be carried out by screwing or unscrewing the relative bushing element 36 on the relative tubular element 35.

As visible in FIGS. 1 and 2, each output shaft 18 further includes a main portion 18*b*, extending, in a sealed manner, through the relative opening 25 of bottom head wall 22 of drum casing 20 and within the protected or sterile atmosphere area 30; each output shaft 18 further includes a bottom portion 18*c* directly connected to the relative operating head 7.

In particular, in the example of FIGS. 1 and 2, bottom head wall 22 further includes, for each operating unit 4, a sleeve element 50 mounted through the relative opening 25 and having an end annular flange 51 secured by screws 52 to the bottom head wall 22 itself on the side thereof arranged inside drum casing 20 and facing top head wall 23.

Each sleeve element 50 presents, at its radially inner surface, a plurality of longitudinal slots 53 parallel to axes A, B and configured to allow longitudinal axial displacements of the relative output shaft 18 along its axis B, as it will be described in further detail hereafter.

As a possible alternative not shown, longitudinal slots 53 may be directly formed on the inner delimiting surface of the relative opening 25 of the bottom head wall 22.

In the example shown in FIGS. 1 and 2, each operating unit 4 also comprises a tubular slider 54 mounted radially interposed between the relative sleeve element 50 and the main portion 18*b* of the relative output shaft 18. The slider 54 is provided with longitudinal projections 55 radially protruding from the slider radially outer surface and engaging, in a sliding manner parallel to the relative axis B, the respective longitudinal slots 53. Interaction of longitudinal projections 55 with the respective longitudinal slots 53 allows guiding translational movements of the sliders 54 along their axes B.

The main portion 18*b* of each output shaft 18 extends through the respective slider 54 and is coupled to the slider 54 itself in a fixed axial position and in a free rotary manner. In particular, the main portion 18*b* of each output shaft 18 is supported within the relative slider 54 by a pair of bearings 56, preferably by ball bearings.

In order to seal axial movements of each slider 54 within the protected or sterile atmosphere area 30, the relative operating unit 4 also includes an annular bellows element 57. In particular, the bellows element 57 has one axial end 58, secured in a sealed manner to bottom head wall 22 of drum casing 20, and one opposite axial end 59 secured in a sealed manner to a bottom axial end 60 of the slider 54. The bellows element 57 is formed in a known manner by a plurality of interconnected frustoconical rings 61 with alternate conicalness. The rings 61 can be folded onto each other to define a retracted minimum axial length of the bellows element 57 or can be axially expanded to define an expanded maximum axial length of the bellows element 57 itself.

In this way, any axial movement of each slider 54 and the relative output shaft 18 are followed by retraction or expansion of the corresponding bellows element 57.

Rotational movements of each output shaft 18 with respect to the relative slider 54 are sealed by an annular gasket 62 carried by the bottom axial end 60 of the slider 54 itself at its bottom mouth. In particular, each gasket 62 has an annular lip 63 cooperating in contact with or scraping against the bottom portion 18*c* of the relative output shaft 18.

In use, the containers 3, already filled with a pourable product, are loaded onto the respective container support elements 6 and moved by these around the axis A.

During this rotation, the operating units 4 perform the operations of applying the capsules 2 on the respective containers 3.

In particular, each operating head 7 is moved axially along, and is rotated about, the relative axis B by the relative motor assembly 10 and driving mandrel 8 while the operating head 7 itself rotates together with the driving shaft 5 around the axis A.

For the sake of clarity, the following description will be referred to one single operating unit 4 acting on one single container 3 for applying one relative capsule 2; it is evident that the same sequence of steps applies to any other operating unit 4 for performing the capping operation of the respective container 3.

When the container 3 to be capped is located below the operating head 7 provided with the capsule 2 to be applied, an axial movement along axis B towards the container 3 itself is imparted by motor assembly 10 and driving mandrel 8 to the input element 17 of torque control head 11. The same axial movement is transmitted to the output shaft 18 and slider 54 as well as to the operating head 7. As the operating head 7 contacts the container 3, the spring 41 is compressed with a relative axial movement of the input element 17, output shaft 18 and slider 54 with respect to the driving portion 15 of driving mandrel 8. This relative axial movement is allowed by sliding engagement between slots 39 and pins 40 and permits to cushion contact between the operating head 7 and the container 3.

In general, during any axial movement, the seal between the protected or sterile atmosphere area 30 and the unprotected or unsterile atmosphere area 31 is achieved by bellows element 57 that retracts or expands following the axial movements of the output shaft 18 and the relative slider 54 towards and away from the bottom head wall 22.

After contact between the operating head 7 and the container 3, a roto-translational movement with respect to axis B is imparted by motor assembly 10 and driving mandrel 8 to input element 17 of torque control head 11.

This movement is transmitted to the output shaft 18 and therefore to the operating head 7 by magnetic clutch 45 and produces screwing of the capsule 2 on the container 3. At the end of the stroke of the capsule 2, further rotation of the capsule 2 itself requires to overcome the resistance torque exerted by the container 3. As such resistance torque exceeds the maximum torque that can be transmitted to the output shaft 18 by the magnetic clutch 45, a relative rotation between top and bottom magnets 47, 48 occurs, so avoiding to force the capsule 2 on the container 3 with possible damages to their threads.

Following completion of the capping operation, the operating head 7, the output shaft 18, the slider 54 and the input element 17 are moved axially away from the capped container 3, so permitting release thereof from the capping machine 1.

The advantages of the capping machine 1 as shown in FIGS. 1 and 2 are clearly evident from the foregoing description.

In particular, this solution permits to minimize the number of gaskets and seals necessary to isolate the parts of each operating unit 4 housed within the protected or sterile atmosphere area 30, while maintaining the same functionality as that of known operating units. In fact, in the present case, only one annular gasket 61 and one annular bellows element 57 are sufficient to guarantee the necessary sealing between each operating unit 4 and the protected or sterile atmosphere area 30.

It should be also noted that each output shaft 18 is well radially supported up to the zone close to the relative operating head 7.

In addition, thanks to the fact that the torque control head 11 of each operating unit 4 is arranged above the bottom head wall 22 and therefore outside the protected or sterile atmosphere area 30, the size of this latter area and the possible points of contamination can be minimized. Moreover, it is possible to use a regular torque control head instead of an aseptic one.

Furthermore, in a bottling plant operating in sterile or ultraclean conditions, the roof part (i.e. the bottom head wall 22) of the protected or sterile atmosphere area 30 of the capping machine 1 can be arranged at the same height as the corresponding roof part of the protected or sterile atmosphere area of adjacent filling machine.

Figure 3:
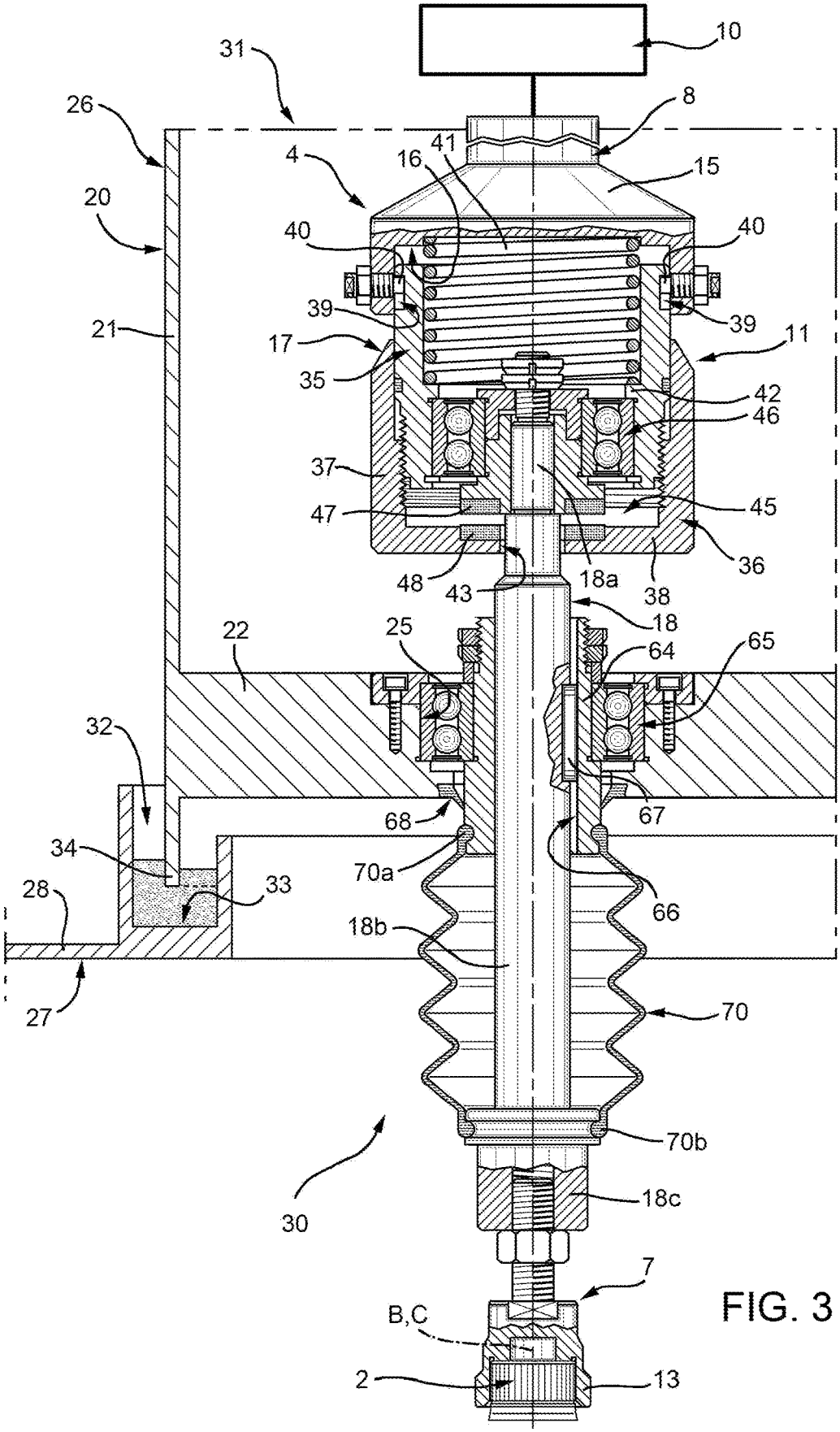
FIG. 3 is a section analogous to FIG. 2 and relative to a possible variant of the capping machine of FIGS. 1 and 2.

The variant of FIG. 3 only differs from the solution of FIGS. 1 and 2 in the way in which each output shaft 18 extends in a sealed manner through the relative opening 25 of the bottom head wall 22 of drum casing 20 within the protected or sterile atmosphere area 30.

In particular, in this case, the main portion 18*b* of each output shaft 18 is angularly coupled to an outer sleeve element 64, in turn mounted in a fixed axial position and in a free rotary manner within the relative through opening 25 of the bottom head wall 22 of drum casing 20. More specifically, each sleeve element 64 is supported within the relative opening 25 by a bearing 65, in particular by a ball bearing.

Each sleeve element 64 is also provided with a plurality of longitudinal grooves 66 parallel to axes A, B and configured to be engaged in a sliding manner in use by respective radial projections 67 of the main portion 18*b* of the relative output shaft 18.

In this way, each output shaft 18 is able to translate axially along its axis B with respect to the relative sleeve element 64 and is also adapted to rotate about such axis B together with the sleeve element 64 itself with respect to bottom head wall 22 of drum casing 20.

Sealing of the rotational movement of the assembly formed by the main portion 18*b* of each output shaft 18 and the relative sleeve element 64 with respect to bottom head wall 22 of drum casing 20 is achieved by an annular gasket 68 mounted at the bottom edge of the relative opening 25 and cooperating in use in contact with an outer surface of the sleeve element 64 itself.

Sealing of the translational movement of each output shaft 18 from the unprotected or unsterile atmosphere area 31 to the protected or sterile atmosphere area 30 and vice versa is achieved by an annular bellows element 70, similar to bellows element 57 and not further described hereafter, having its top axial end 70*a*, secured in a sealed manner to a bottom edge of the relative sleeve element 64, and its bottom axial end 70*b*, secured in a sealed manner to the main portion 18*b* of the output shaft 18 itself proximate to the bottom portion 18*c*.

The advantages of the solution of FIG. 3 are the same as achieved by the solution of FIGS. 1 and 2 and will not be repeated for the sake of conciseness.

In addition, in the solution of FIG. 3, no bearing is present within the protected or sterile atmosphere area 30 (the only bearing present is located within the opening 25 of bottom head wall 20).

Clearly, changes may be made to capping machine 1 as described herein without, however, departing from the scope of protection as defined in the accompanying claims.

The invention claimed is:

1. A capping machine (1) for applying capsules (2) on respective containers (3), said machine (1) comprising:

a protected area (30) from impurities in which the containers (3) pass;

an unprotected area (31) divided from said protected area (30) by a parting wall (32) in such a way that said protected area (30) extends below the parting wall (22) itself;

sealing means (22) for separating the protected (30) and unprotected areas (31) from one another; and at least one operating unit (4) configured to perform a capping operation on the containers (3), arranged coaxially to a vertical axis (B) orthogonal to said parting wall (22) and extending in part above said parting wall (22) in the unprotected area (31), in part through an opening (25) of said parting wall (22) and in part below said parting wall in the protected area (30);

wherein said operating unit comprises:

at least one container support element (6) arranged in the protected area (30) and configured to support one container (3) coaxially to the vertical axis (B);

at least one operating head (7) arranged in the protected area (30) and configured to apply at least one capsule (2) on the container (3) held by the container support element (6);

a motor assembly (10) arranged in said unprotected area (31) and configured to drive motion of the operating head (7) along and/or around said vertical axis (B);

a torque control head (11) interposed between said motor assembly (10) and said operating head (7) and configured to limit the maximum torque transmitted from the motor assembly (10) to an output shaft (18) coupled to the operating head (7); and an annular bellows element (57, 70) arranged coaxially with said vertical axis (B) and within said protected area (30) and having a first axial end (58, 70*a*) adjacent to said parting wall (22) and an opposite second axial end (59, 70*b*) crossed in a sealed manner by said output shaft (18); said bellows element (57, 70) being configured to retract and expand axially following the corresponding movements of said output shaft (18);

wherein said torque control head (11) is arranged above said parting wall (22) in the unprotected area (31), and in that said output shaft (18) axially crosses both said opening (25) of said parting wall (22) and the entire bellows element (57, 70); and wherein said output shaft (18) is supported in a free rotary manner within said opening (25) of said parting wall (22) by at least one bearing (56, 65);

wherein said operating unit (4) further comprises a sleeve element (64) coaxially extending through the opening (25) of the parting wall (22), radially supported within said opening (25) by said at least one bearing (65) in a fixed axial position and in a free rotary manner, axially crossed by said output shaft (18) and angularly coupled to the output shaft (18) itself; wherein said output shaft (18) is coupled to said sleeve element (64) in a sliding manner along said vertical axis (B); and wherein said first axial end (70*a*) of said bellows element (70) is secured in a sealed manner to an edge of the sleeve element (64) arranged within the protected area (30), and said second axial end (70*b*) of said bellows element (70) is secured in a sealed manner to an outer surface of said output shaft (18).

2. The machine as claimed in claim 1, further including comprising an annular gasket (68) mounted at an edge of said opening (25) facing said protected area (30) and cooperating in use in contact with an outer surface of the sleeve element (64) itself.

3. The machine as claimed in claim 2, wherein said torque control head (11) comprises:

an input element (17) connected to a driving mandrel (8) in turn operated by said motor assembly (10);

said output shaft (18); and a magnetic clutch (45) for transmitting angular motion about said vertical axis (B) from said input element (17) to said output shaft (18).

4. Machine according to claim 2, comprising:

a plurality of operative units (4) having respective said vertical axis (B) and angularly spaced from each other around a central axis (A) parallel to said vertical axes (B); and a driving shaft (5) coaxial to said central axis (A) and angularly connected to the operating units (4) and to said parting wall (22);

wherein said driving shaft (5), said parting wall (22) and said operating units (4) define a rotational part (26) of said machine (1) cooperating with a fixed part (27) of the machine (1) itself arranged in a radially outermost position; and wherein sealing means (22) are provided between said rotational part (26) and said fixed part (27).

5. The machine as claimed in claim 2, in which the said protected area is a sterile area (30).

6. The machine as claimed in claim 1, wherein said operating unit (4) further comprises a tubular slider (54) mounted through said opening (25) of said parting wall (22) in a sliding manner along said vertical axis (B) and protruding from the parting wall (22) itself within said protected area (30); wherein said output shaft (18) is radially supported in a fixed axial position and in free rotary manner within said slider (54) by said at least one bearing (56) and by a further bearing (56) adjacent to a bottom axial end (60) of the slider (54) itself arranged in the protected area; and wherein said first axial end (58) of said bellows element (57) is secured in a sealed manner to an edge of said opening (25) facing said protected area (30), and said second axial end (59) of said bellows element (57) is secured to said bottom axial end (60) of said slider (54).

7. The machine as claimed in claim 6, wherein said operating unit (4) further includes an annular gasket (62) carried by said bottom axial end (60) of the slider (54) and radially cooperating in contact with a portion of said output shaft (18) axially protruding from said slider (54) towards said container support element (6).

8. The machine as claimed in claim 1, wherein said torque control head (11) comprises:

an input element (17) connected to a driving mandrel (8) in turn operated by said motor assembly (10);

said output shaft (18); and a magnetic clutch (45) for transmitting angular motion about said vertical axis (B) from said input element (17) to said output shaft (18).

9. The machine according to claim 1, comprising:

a plurality of operative units (4) having respective said vertical axis (B) and angularly spaced from each other around a central axis (A) parallel to said vertical axes (B); and a driving shaft (5) coaxial to said central axis (A) and angularly connected to the operating units (4) and to said parting wall (22);

wherein said driving shaft (5), said parting wall (22) and said operating units (4) define a rotational part (26) of said machine (1) cooperating with a fixed part (27) of the machine (1) itself arranged in a radially outermost position; and wherein sealing means (22) are provided between said rotational part (26) and said fixed part (27).

10. The machine as claimed in claim 9, wherein said sealing means (22) comprise a fixed annular channel (33), associated with said fixed part (27) and partially filled with a sterile liquid, and an annular element (34) associated with the rotational part (26), coaxial with the annular channel (33) and rotatable in use in the liquid of the annular channel (33).

11. The machine as claimed in claim 1, in which the said protected area is a sterile area (30).

* * * * *